US010559272B2

(12) United States Patent
Lee et al.

(10) Patent No.: US 10,559,272 B2
(45) Date of Patent: Feb. 11, 2020

(54) DISPLAY DEVICE AND METHOD OF DRIVING THE SAME

(71) Applicant: LG Display Co., Ltd., Seoul (KR)

(72) Inventors: Chulwon Lee, Seoul (KR); Juyoung Noh, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 93 days.

(21) Appl. No.: 15/807,403

(22) Filed: Nov. 8, 2017

(65) Prior Publication Data

US 2018/0144705 A1 May 24, 2018

(30) Foreign Application Priority Data

Nov. 23, 2016 (KR) ..... 10-2016-0156866

(51) Int. Cl.
*G09G 3/36* (2006.01)

(52) U.S. Cl.
CPC ... *G09G 3/3685* (2013.01); *G09G 2320/0204* (2013.01); *G09G 2330/023* (2013.01)

(58) Field of Classification Search
CPC ..... G09G 3/3685; G09G 3/3225; G09G 2300/0452; G09G 2300/0819; G09G 2300/0876; G09G 2320/0204; G09G 2320/0209; G09G 2320/029; G09G 2320/0295; G09G 2320/045; G09G 2330/023; G09G 2330/12
USPC ..... 345/694
See application file for complete search history.

(56) References Cited

U.S. PATENT DOCUMENTS

2015/0154899 A1* 6/2015 Chang ..... G09G 3/3233 345/76
2016/0086545 A1 3/2016 Matsueda et al.
2016/0189614 A1 6/2016 Tani et al.

FOREIGN PATENT DOCUMENTS

EP 2889862 A1 7/2015
JP 2009-300752 A 12/2009

OTHER PUBLICATIONS

British Search Report, British Patent Application No. 1801115.5, dated Jul. 16, 2018, 3 pages.
Extended European Search Report, European Patent Application No. 18151109.8, dated Jan. 17, 2019, 5 pages.

* cited by examiner

*Primary Examiner* — Jennifer Mehmood
*Assistant Examiner* — Ngan T Pham Lu
(74) *Attorney, Agent, or Firm* — Fenwick & West LLP

(57) ABSTRACT

A display device and a method of driving the same are disclosed. The display device includes a display panel configured to display an image, and a parasitic capacitor compensation circuit including a compensation capacitor connected to a sensing line of the display panel and a control switch configured to perform a switching operation so that the compensation capacitor has a predetermined capacitance. The control switch is turned on in an image display operation of the display panel and is turned off in a sensing operation of the display panel.

16 Claims, 14 Drawing Sheets

→ △Vref = Cpara./(Cpara.+Cref.) * △Vdata

→ △Vref ↓ = Cpara./(Cpara.+Cref. ↑) * △Vdata

DISPLAY DEVICE AND METHOD OF DRIVING THE SAME

CROSS-REFERENCE TO RELATED APPLICATIONS

This application claims the benefit of Republic of Korea Patent Application No. 10-2016-0156866, filed on Nov. 23, 2016, which is incorporated by reference herein in its entirety.

BACKGROUND

Field of Technology

The present disclosure relates to a display device and a method of driving the same.

Discussion of the Related Art

With the development of information technology, the market of display devices used as a connection medium between a user and information is growing. Thus, the use of display devices, such as an organic light emitting diode (OLED) display, a liquid crystal display (LCD), and a plasma display panel (PDP), is on the rise.

An OLED display includes a display panel including a plurality of subpixels and a driver for driving the display panel. The driver includes a scan driver for supplying a scan signal (or a gate signal) to the display panel, a data driver for supplying a data signal to the display panel, and the like.

When the scan signal and the data signal are supplied to the subpixels arranged in a matrix, the subpixels selected in response to the scan signal and the data signal emit light. Hence, the OLED display can display an image.

When the OLED display is used for a long time, the OLED display has a problem in that some of the components included in the subpixels experience a change in characteristics (for example, threshold voltage, current mobility, etc.). In order to compensate for the change in the characteristics, a method according to a related art has been proposed to add a sensing circuit for sensing characteristics of components included in subpixels. However, the OLED display according to the related art causes a problem of image quality due to coupling between a data voltage and a parasitic capacitor when the data voltage is changed, and thus improvement thereof is required.

SUMMARY

In one aspect, there is provided a display device comprising a display panel configured to display an image, and a parasitic capacitor compensation circuit including a compensation capacitor connected to a sensing line of the display panel and a control switch configured to perform a switching operation so that the compensation capacitor has a predetermined capacitance, wherein the control switch is turned on in an image display operation of the display panel and is turned off in a sensing operation of the display panel.

In another aspect, there is provided a display device comprising a display panel including a plurality of subpixels, a compensation circuit including a sensing transistor and a sensing line, the sensing transistor configured to sense a sensing node between a source electrode of a driving transistor included in each subpixel and an anode electrode of an organic light emitting diode included in each subpixel, the sensing line configured to transmit a sensing result obtained by the sensing transistor, and a parasitic capacitor compensation circuit including a compensation capacitor connected to the sensing line of the compensation circuit and a control switch configured to perform a switching operation for applying a voltage to the compensation capacitor or electrically floating the compensation capacitor.

In yet another aspect, there is provided a method of driving a display device including a display panel including a plurality of subpixels, a compensation circuit including a sensing transistor sensing a sensing node between a source electrode of a driving transistor included in each subpixel and an anode electrode of an organic light emitting diode included in each subpixel and a sensing line transmitting a sensing result obtained by the sensing transistor, and a parasitic capacitor compensation circuit including a compensation capacitor connected to the sensing line and a control switch performing a switching operation so that the compensation capacitor has a predetermined capacitance, the method comprising turning on the control switch in an image display operation of the display panel, and turning off the control switch in a sensing operation of the display panel.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention.

DETAILED DESCRIPTION

Figure 1:
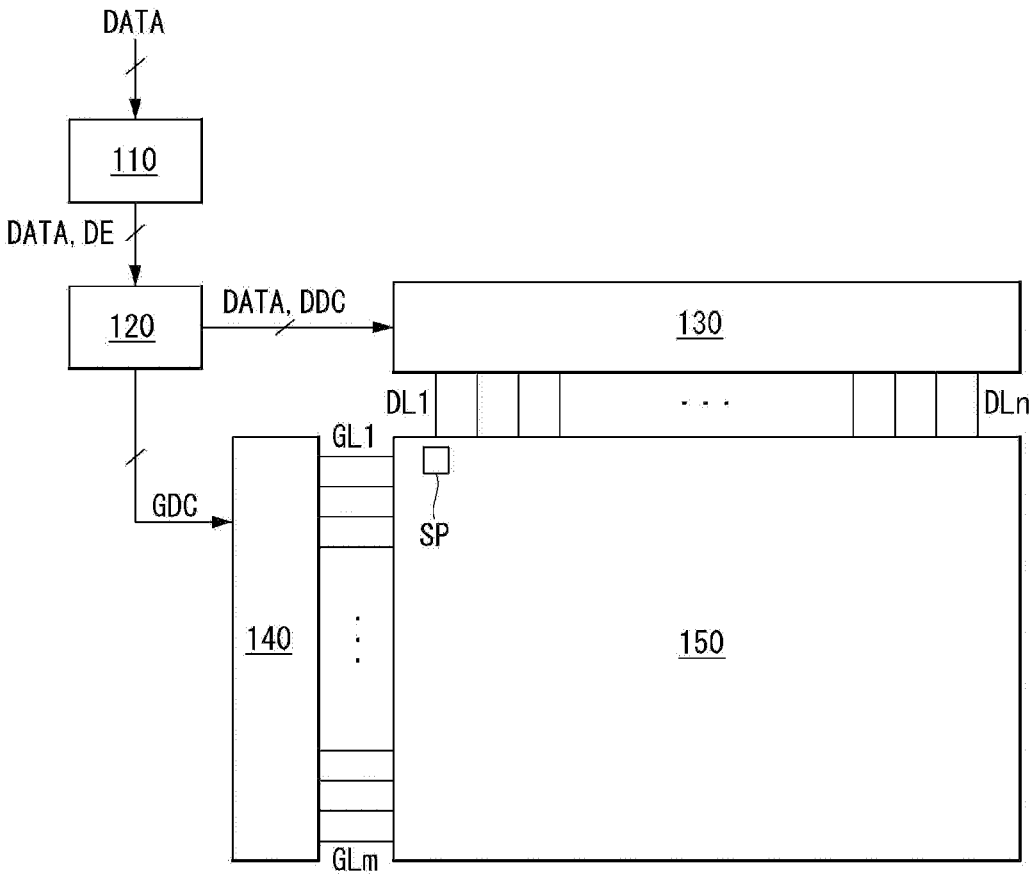
FIG. 1 is a schematic block diagram of an organic light emitting diode (OLED) display in accordance with one embodiment of the present disclosure.

Reference will now be made in detail to embodiments of the present disclosure, examples of which are illustrated in the accompanying drawings. Wherever convenient for explanation of the embodiments provided herein, the same reference numbers will be used throughout the drawings to refer to the same or like parts. In the present disclosure, a detailed description of known components or functionalities may be omitted if it is determined that a detailed description of such known components or functionalities may mislead or otherwise obscure the description of the embodiments of the present disclosure.

A display device according to embodiments may be implemented as a television system, a video player, a personal computer (PC), a home theater system, a smart phone, and the like. In the following description, a display device according to embodiments may be an organic light emitting diode (OLED) display implemented based on organic light emitting diodes, as an example. The OLED display according to embodiments performs an image display operation for displaying an image and an external compensation operation for compensating for changes in characteristics (or time-varying characteristics) of components over time.

The external compensation operation may be performed in a vertical blanking interval during the image display operation, in a power-on sequence interval before the beginning of the image display operation, or in a power-off sequence interval after the end of the image display operation. The vertical blanking interval is a period of time during which a data signal for image display is not applied, and is arranged between vertical active periods in which the data signal for one frame is applied.

The power-on sequence interval is a period of time between the turn-on of electric power for driving a display device and the beginning of an image display period, during which images are displayed on the display device. The power-off sequence interval is a period of time between the end of an image display period and the turn-off of electric power for driving the device.

An external compensation method performing the external compensation operation may operate a driving transistor in a source follower manner and then sense a voltage (for example, a source voltage of the driving transistor) stored in a line capacitor of a sensing line, but is not limited thereto. The line capacitor means a specific capacitance existing on the sensing line.

In order to compensate for a variation in a threshold voltage of the driving transistor, the external compensation method senses a source voltage when a voltage of a source node of the driving transistor is saturated (i.e., when a current Ids of the driving transistor is zero). Further, in order to compensate for a variation in mobility of the driving transistor, the external compensation method senses the voltage of the source node in a linear state before the voltage of the source node of the driving transistor is saturated.

In the following description, electrodes of a thin film transistor except a gate electrode may be referred to as a source electrode and a drain electrode, or a drain electrode and a source electrode, depending on types of thin film transistors. In addition, in the following description, a source electrode and a drain electrode, or a drain electrode and a source electrode, of the thin film transistor may be referred to as a first electrode and a second electrode.

Figure 2:
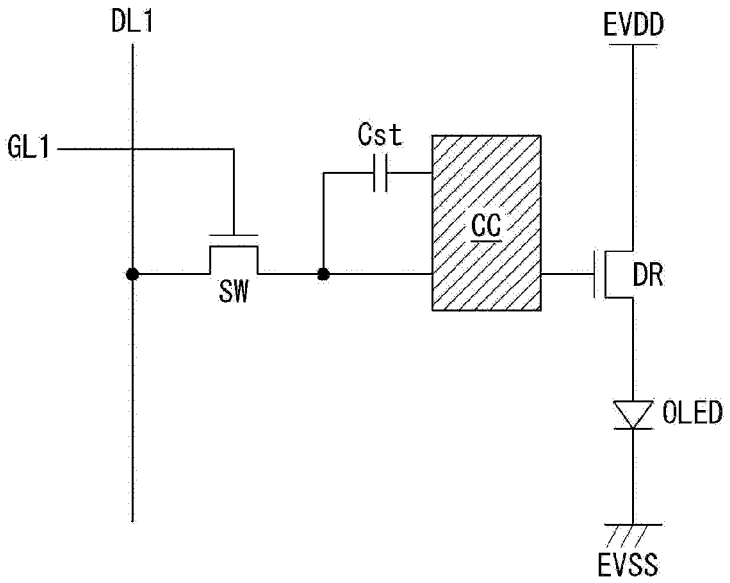
FIG. 2 schematically illustrates a circuit configuration of a subpixel in accordance with one embodiment of the present disclosure.
Figure 3:
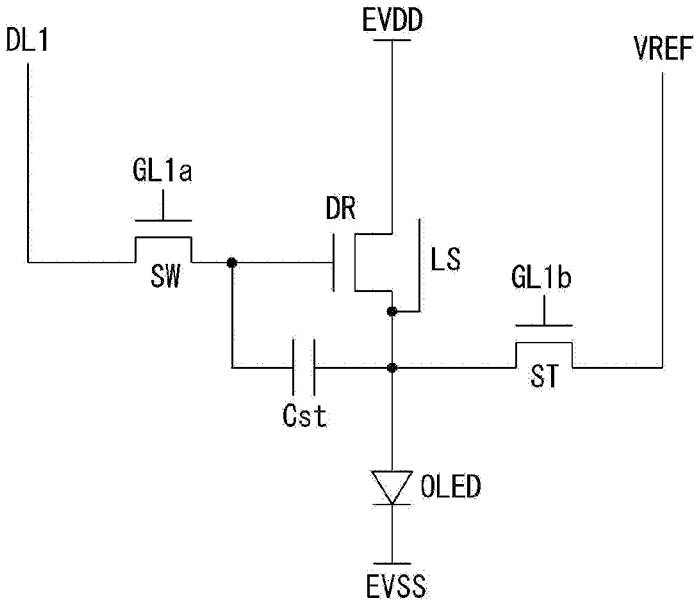
FIG. 3 illustrates in detail a circuit configuration of a subpixel in accordance with one embodiment of the present disclosure.
Figure 4:
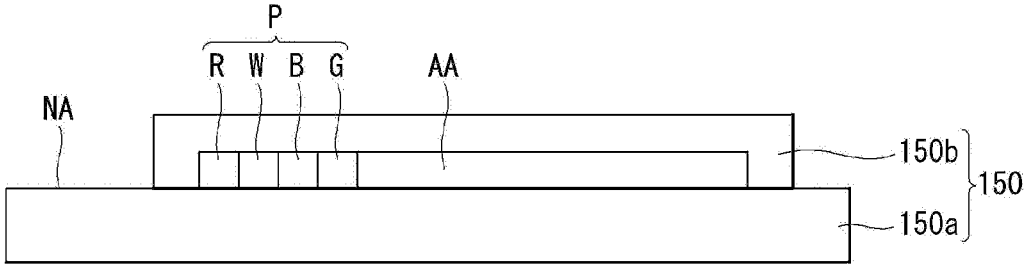
FIG. 4 is an exemplary cross-sectional view of a display panel in accordance with one embodiment of the present disclosure.
Figure 5:
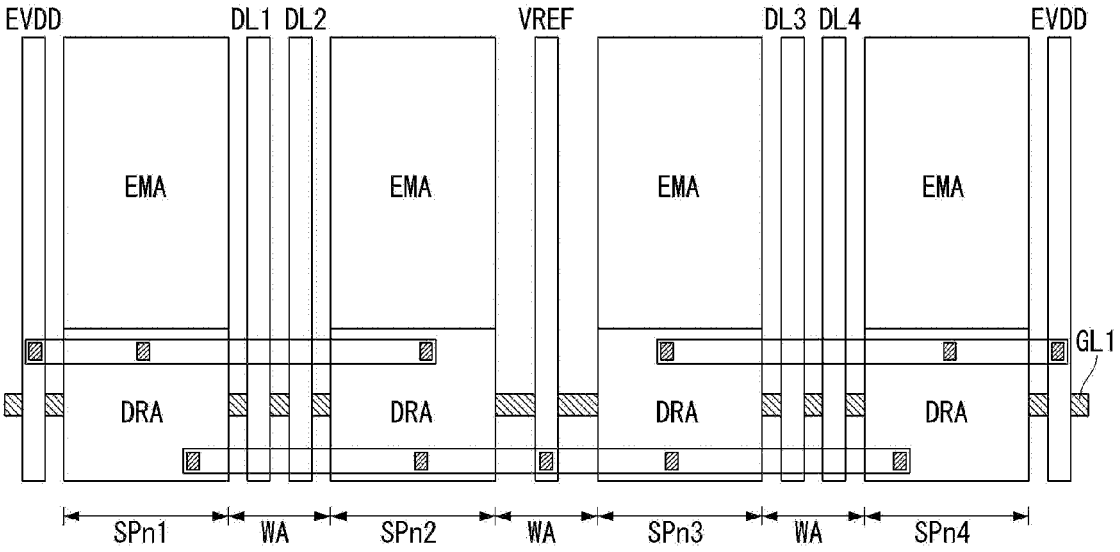
FIG. 5 is an exemplary plan view of a subpixel in accordance with one embodiment of the present disclosure.
Figure 6:
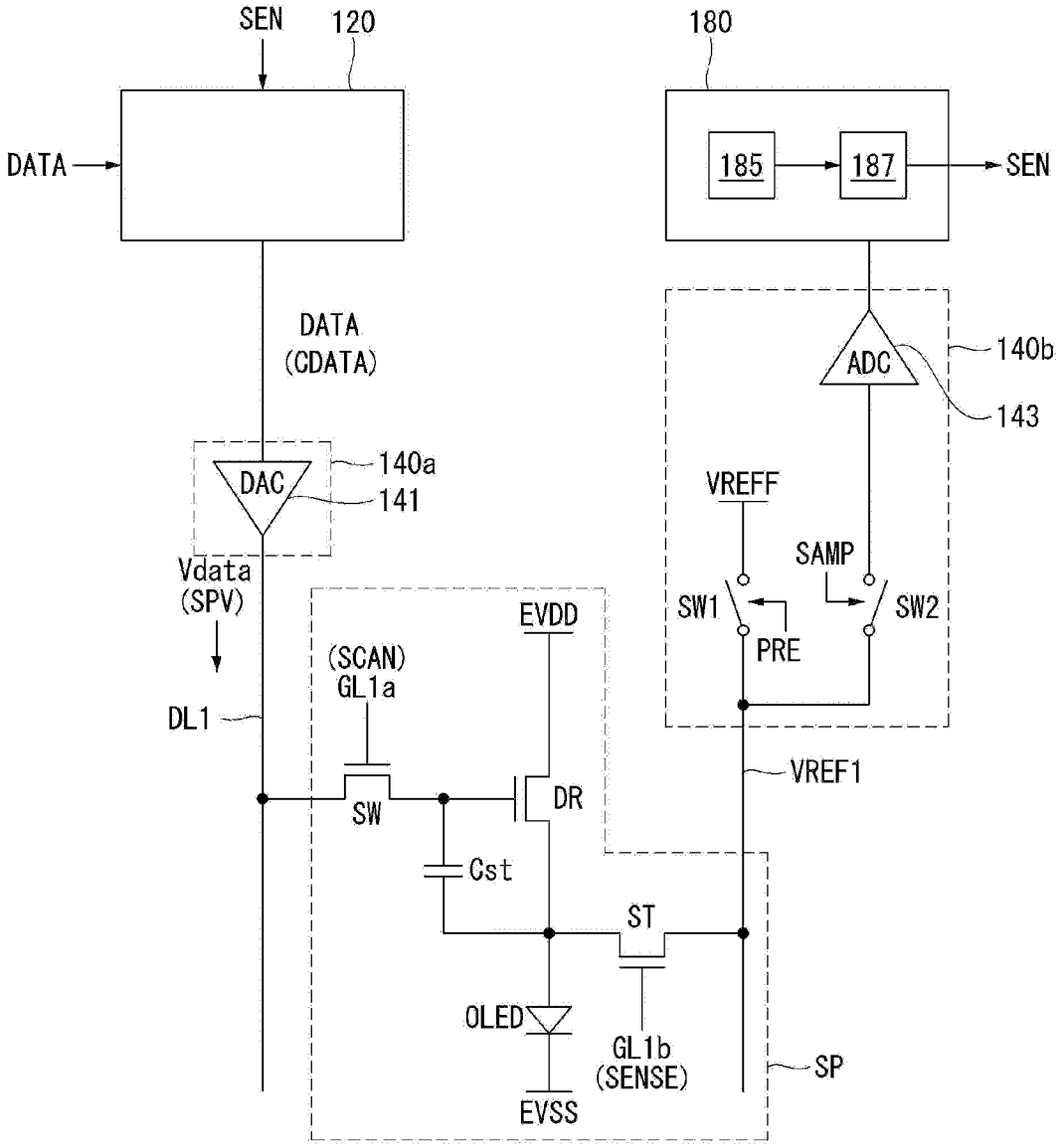
FIG. 6 is a schematic block diagram of an external compensation circuit in accordance with one embodiment of the present disclosure.
Figure 7:
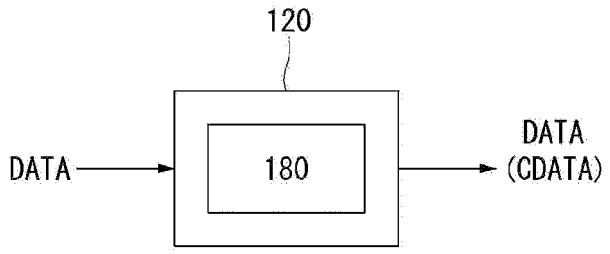
FIG. 7 is a schematic block diagram of a timing controller including a data compensator in accordance with one embodiment of the present disclosure.

FIG. 1 is a schematic block diagram of an OLED display. FIG. 2 schematically illustrates a circuit configuration of a subpixel. FIG. 3 illustrates in detail a circuit configuration of a subpixel. FIG. 4 is an exemplary cross-sectional view of a display panel. FIG. 5 is an exemplary plan view of a subpixel. FIG. 6 is a schematic block diagram of an external compensation circuit. FIG. 7 is a schematic block diagram of a timing controller including a data compensator.

As shown in FIG. 1, an OLED display according to an embodiment includes an image processing unit 110, a timing controller 120, a data driver 130, a scan driver 140, and a display panel 150.

The image processing unit 110 outputs a data signal DATA and a data enable signal DE supplied from outside of the display device. The image processing unit 110 may further output one or more of a vertical sync signal, a horizontal sync signal, and a clock signal in addition to the data signal DATA and data enable signal DE. For the sake of brevity and ease of reading, these signals are not shown.

The timing controller 120 receives the data signal DATA and the data enable signal DE, and may further receive driving signals including the vertical sync signal, the horizontal sync signal, the clock signal, etc., from the image processing unit 110. The timing controller 120 outputs a gate timing control signal GDC for controlling operation timing of the scan driver 140 and a data timing control signal DDC for controlling operation timing of the data driver 130 based on the driving signals.

The data driver 130 samples and latches the data signal DATA received from the timing controller 120 in response to the data timing control signal DDC supplied from the timing controller 120 and converts the sampled and latched data signal DATA using gamma reference voltages. The data driver 130 outputs the converted data signal DATA to data lines DL1 to DLn. The data driver 130 may be formed as an integrated circuit (IC).

The scan driver 140 outputs a scan signal in response to the gate timing control signal GDC supplied from the timing controller 120. The scan driver 140 outputs the scan signal to scan lines GL1 to GLm. The scan driver 140 is formed as an IC or is formed on the display panel 150 in a gate-in-panel (GIP) manner.

The display panel 150 displays an image in response to the data signal DATA and the scan signal respectively received from the data driver 130 and the scan driver 140. The display panel 150 includes subpixels SP configured to display an image.

The subpixels SP may include red, green, and blue subpixels, or may include white, red, green, and blue subpixels. The subpixels SP may have one or more different emission areas depending on emission characteristics.

As shown in FIG. 2, each subpixel may include a switching transistor SW, a driving transistor DR, a capacitor Cst, a compensation circuit CC, and an organic light emitting diode OLED.

The switching transistor SW performs a switching operation so that a data signal supplied through a first data line DL1 is stored in the capacitor Cst as a data voltage in response to a scan signal supplied through a first scan line GL1. The driving transistor DR enables a driving current to flow between a first power line (or referred to as "high potential power line") EVDD and a second power line (or referred to as "low potential power line") EVSS based on the data voltage stored in the capacitor Cst. The organic light emitting diode OLED emits light depending on the driving current provided by the driving transistor DR.

The compensation circuit CC is a circuit that is added to the subpixel and compensates for a characteristic, such as a threshold voltage, etc., of the driving transistor DR. The compensation circuit CC includes one or more transistors. Configuration of the compensation circuit CC may be variously changed in accordance with various embodiments, depending on an external compensation method and is described below with reference to FIG. 3.

As shown in FIG. 3, the compensation circuit CC may include a sensing transistor ST and a sensing line (or referred to as "reference line") VREF. The sensing transistor ST is connected between the sensing line VREF and a node (hereinafter referred to as "sensing node") that is electrically coupled to a source electrode of the driving transistor DR and to an anode electrode of the organic light emitting diode OLED. The sensing transistor ST may supply an initialization voltage (or referred to as "sensing voltage") transmitted through the sensing line VREF to the sensing node of the driving transistor DR, or may sense a voltage or a current of the sensing node of the driving transistor DR or a voltage or a current of the sensing line VREF.

A first electrode of the switching transistor SW is connected to the first data line DL1, and a second electrode of the switching transistor SW is connected to a gate electrode of the driving transistor DR. A first electrode of the driving transistor DR is connected to the first power line EVDD, and a second electrode of the driving transistor DR is connected to the anode electrode of the organic light emitting diode OLED. A first electrode of the capacitor Cst is connected to the gate electrode of the driving transistor DR, and a second electrode of the capacitor Cst is connected to the anode electrode of the organic light emitting diode OLED. The anode electrode of the organic light emitting diode OLED is connected to the second electrode of the driving transistor DR, and a cathode electrode of the organic light emitting diode OLED is connected to the second power line EVSS. A first electrode of the sensing transistor ST is connected to the sensing line VREF, and a second first electrode of the sensing transistor ST is connected to the sensing node, i.e., the anode electrode of the organic light emitting diode OLED and the second electrode of the driving transistor DR.

An operation time of the sensing transistor ST may be similar to (or the same as) or different from an operation time of the switching transistor SW depending on an external compensation algorithm (or depending on a configuration of the compensation circuit). For example, a gate electrode of the switching transistor SW may be connected to a 1a scan line GL1*a*, and a gate electrode of the sensing transistor ST may be connected to a 1b scan line GL1*b*. As another example, the gate electrode of the switching transistor SW and the gate electrode of the sensing transistor ST may share the 1a scan line GL1*a* or the 1b scan line GL1*b* and thus the gate electrodes of the switching transistor SW and the sensing transistor ST may be connected.

The sensing line VREF may be connected to the data driver, e.g., the data driver 130 shown in FIG. 1. In this instance, the data driver may sense the sensing node of the subpixel, via the sensing line VREF, during a non-display period of a real-time image or N frame period and generate a result of the sensing, where N is an integer equal to or greater than 1. The switching transistor SW and the sensing transistor ST may be turned on at the same time. In such a case, a sensing operation using the sensing line VREF and a data output operation, for driving the organic light-emitting diode OLED based on the data signal output by the data driver, are separated (or distinguished) from each other in accordance with a time-division driving method of the data driver.

In addition, a compensation target according to the sensing result may be a digital data signal, an analog data signal, a gamma signal, or the like. The compensation circuit for generating a compensation signal (or a compensation voltage) based on the sensing result may be implemented inside the data driver, inside the timing controller, or as a separate circuit.

A light shielding layer LS may be disposed only below a channel region of the driving transistor DR. Alternatively, the light shielding layer LS may be disposed below the channel region of the driving transistor DR and below channel regions of the switching transistor SW and the sensing transistor ST. The light shielding layer LS may be simply used for shielding external light. In addition, the light shielding layer LS may be connected to another electrode or another line and used as an electrode constituting the capacitor, etc.

FIG. 3 illustrates the subpixel having a 3T(Transistor)1C (Capacitor) configuration, including the switching transistor SW, the driving transistor DR, the capacitor Cst, the organic light emitting diode OLED, and the sensing transistor ST, by way of example. However, when the compensation circuit CC is added to the subpixel, the subpixel may have various configurations such as 3T2C, 4T2C, 5T1C, and 6T2C.

As shown in FIG. 4, subpixels are formed on a display area AA of a first substrate (or referred to as "thin film transistor substrate") 150*a*, and each subpixel may have the circuit structure illustrated in FIG. 3. The subpixels on the display area AA are sealed by a protective film (or referred to as "protective substrate") 150*b*. In FIG. 4, the reference "NA" denotes a non-display area of the display panel 150. The first substrate 150*a* may be formed of a rigid or semi-rigid material such as glass, or it may be formed of a flexible material.

The subpixels are arranged on a surface of the first substrate 150*a*, and may be horizontally or vertically arranged in order of red (R), white (W), blue (B), and green (G) subpixels on the display area AA, depending on an orientation of the first substrate 150*a*. The red (R), white (W), blue (B), and green (G) subpixels together form one pixel P. However, embodiments are not limited thereto. For example, the arrangement order of the subpixels may be variously changed depending on an emission material, an emission area, configuration (or structure) of the compensation circuit, and the like. Further, the red (R), blue (B), and green (G) subpixels may form one pixel P.

With reference to FIGS. 4 and 5, first to fourth subpixels SPn1 to SPn4 each having an emission area EMA and a circuit area DRA are formed on the display area AA of the first substrate 150*a*. An organic light emitting diode is formed in the emission area EMA, and a thin film transistor including a switching transistor and a driving transistor is formed in the circuit area DRA. The elements in the emission area EMA and the circuit area DRA are formed through a process for depositing a plurality of metal layers and a plurality of insulating layers.

In the first to fourth subpixels SPn1 to SPn4, the organic light emitting diode in the emission area EMA emits light in response to an operation of the switching transistor and the driving transistor in the circuit area DRA. A line area WA is provided in areas adjacent to sides of each of the first to fourth subpixels SPn1 to SPn4. Power lines, sensing lines, and data lines are disposed in the line area WA.

A first power line EVDD may be positioned on the left side of the first subpixel SPn1, a sensing line VREF may be positioned on the right side of the second subpixel SPn2, and first and second data lines DL1 and DL2 may be positioned between the first subpixel SPn1 and the second subpixel SPn2.

The sensing line VREF may be positioned on the left side of the third subpixel SPn3, the first power line EVDD may further be positioned on the right side of the fourth subpixel SPn4, and the third and fourth data lines DL3 and DL4 may be positioned between the third subpixel SPn3 and the fourth subpixel SPn4.

The first subpixel SPn1 may be electrically connected to the first power line EVDD on the left side of the first subpixel SPn1, the first data line DL1 on the right side of the first subpixel SPn1, and the sensing line VREF on the right side of the second subpixel SPn2. The second subpixel SPn2 may be electrically connected to the first power line EVDD on the left side of the first subpixel SPn1, the second data line DL2 on the left side of the second subpixel SPn2, and the sensing line VREF on the right side of the second subpixel SPn2.

The third subpixel SPn3 may be electrically connected to the sensing line VREF on the left side of the third subpixel SPn3, the third data line DL3 on the right side of third subpixel SPn3, and the first power line EVDD on the right side of the fourth subpixel SPn4. The fourth subpixel SPn4 may be electrically connected to the sensing line VREF on the left side of the third subpixel SPn3, the fourth data line DL4 on the left side of the fourth subpixel SPn4, and the first power line EVDD on the right side of the fourth subpixel SPn4.

The first to fourth subpixels SPn1 to SPn4 may be commonly connected to the sensing line VREF between the second subpixel SPn2 and the third subpixel SPn3, but are not limited thereto. Further, the embodiment of the disclosure described that only one scan line GL1 is disposed, by way of example. However, the scan line may be separated into one scan line or two scan lines depending on a driving manner.

The lines such as the first power line EVDD and the sensing line VREF and electrodes constituting the thin film transistor are positioned on different layers, but are electrically connected to each other through contact holes (or via holes). The contact holes are formed through a dry or wet etching process to partially expose the electrode, the signal line, or the power line positioned on a lower part of the subpixel.

As shown in FIGS. 1 and 6, the data driver 130 includes a first circuit unit 140*a* outputting a data signal to a subpixel SP and a second circuit unit 140*b* that senses the subpixel so as to compensate for the data signal.

The first circuit unit 140*a* includes a digital-to-analog converter (DAC) 141 that converts a digital data signal into an analog data signal Vdata and outputs the analog data signal Vdata. An output terminal of the first circuit unit 140*a* is connected to the first data line DL1.

The second circuit unit 140*b* includes a voltage output circuit SW1, a sampling circuit SW2, an analog-to-digital converter (ADC) 143, and the like. The voltage output circuit SW1 operates in response to a charge control signal PRE, and the sampling circuit SW2 operates in response to a sampling control signal SAMP. An input terminal and an output terminal of the second circuit unit 140*b* are connected to a first sensing line VREF1.

The voltage output circuit SW1 operates so that first and second reference voltages generated by a voltage source VREFF are dividedly output to the first sensing line VREF1 and the first data line DL1, respectively. The first and second reference voltages generated by the voltage source VREFF are voltages between a first potential voltage and a second potential voltage.

The first reference voltage and the second reference voltage may be set to be similar to or equal to each other. The first reference voltage may be set to a voltage close to a ground level for use in the external compensation of the display panel, and the second reference voltage may be set to a voltage higher than the first reference voltage for use in a normal driving operation of the display panel. The voltage output circuit SW1 operates only when the first reference voltage and the second reference voltage are output. FIG. 6 illustrates that the voltage output circuit SW1 is merely configured as a switch SW1 and the voltage source VREFF, by way of example. However, embodiments are not limited thereto.

The sampling circuit SW2 serves to sense the subpixel SP through the first sensing line VREF1. The sampling circuit SW2 senses a threshold voltage of the organic light emitting diode OLED, a threshold voltage or mobility of the driving transistor DR, and the like in a sampling manner, and then transmits a sensing value to the analog-to-digital converter 143. FIG. 6 illustrates that the sampling circuit SW2 is simply configured as a switch, by way of example. However, embodiments are not limited thereto. For example, the sampling circuit SW2 may be implemented as an active element and a passive element.

The analog-to-digital converter 143 receives the sensing value from the sampling circuit SW2 and converts an analog voltage value into a digital voltage value. The analog-to-digital converter 143 outputs a sensing value converted into a digital system. The sensing value output from the analog-to-digital converter 143 is supplied to a compensation driver 180.

The compensation driver 180 performs a compensation processing necessary for the external compensation based on the digital sensing value transmitted from the second circuit unit 140*b* of the data driver 130. The compensation driver 180 generates a compensation value necessary for the external compensation based on the sensing value, or amends or adjusts the compensation value. The compensation driver 180 includes a determination unit 185 and a compensation value generator 187.

The determination unit 185 determines the presence or absence of external compensation and a position of a subpixel requiring the external compensation based on the sensing value. The compensation value generator 187 generates a compensation value SEN corresponding to information transmitted from the determination unit 185. The compensation value generator 187 provides the compensation value SEN for the timing controller 120.

The timing controller 120 compensates for the data signal or the like based on the compensation value SEN provided by the compensation value generator 187. The timing controller 120 outputs a compensation data signal CDATA or the data signal DATA depending on whether a compensation operation is performed or not.

As shown in FIGS. 6 and 7, the compensation driver 180 may be included inside or outside the timing controller 120. When the compensation driver 180 is included inside the timing controller 120, the second circuit unit 140*b* of the data driver 130 transmits the sensing value to the timing controller 120.

When the OLED display is used for a long time, the OLED display has a problem in that some of the components included in the subpixels experience a change in characteristics (for example, threshold voltage, current mobility, etc.). In order to compensate for the change in the characteristics, a method according to a related art has been proposed to add a sensing circuit for sensing characteristics of components included in subpixels. However, the OLED display according to the related art causes a problem of image quality due to coupling between the data voltage and a parasitic capacitor when the data voltage is changed, and thus improvement thereof is required.

RELATED ART

Figure 8:
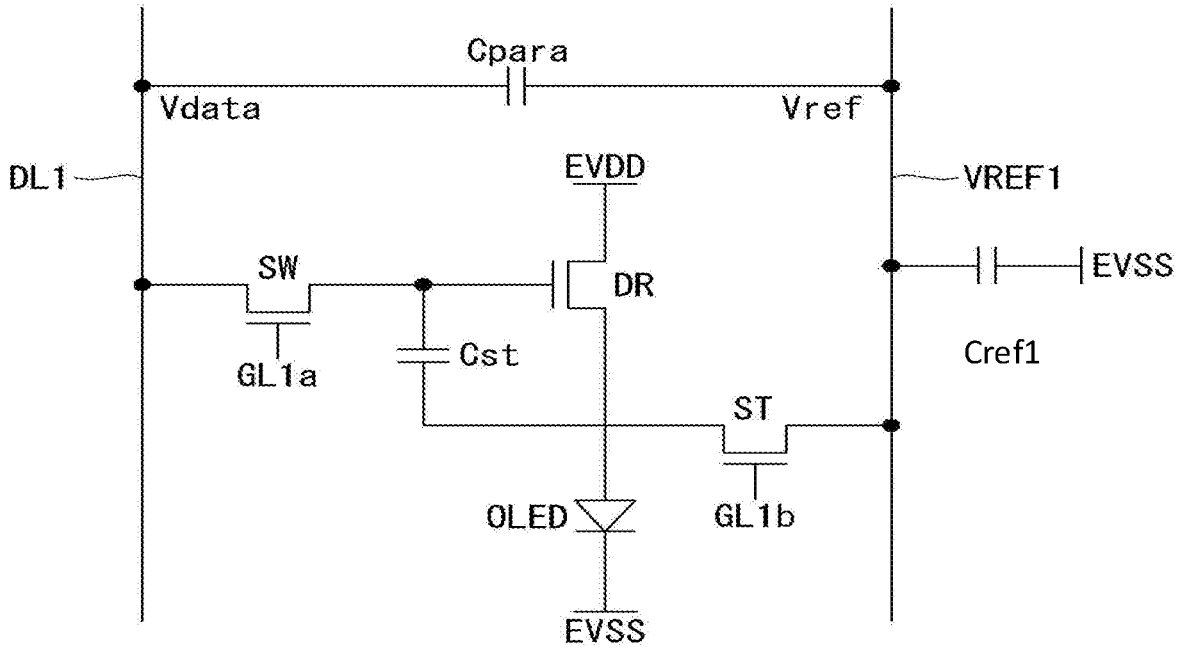
FIG. 8 illustrates a formation portion of a parasitic capacitor in accordance with one embodiment of the present disclosure.
Figure 9:
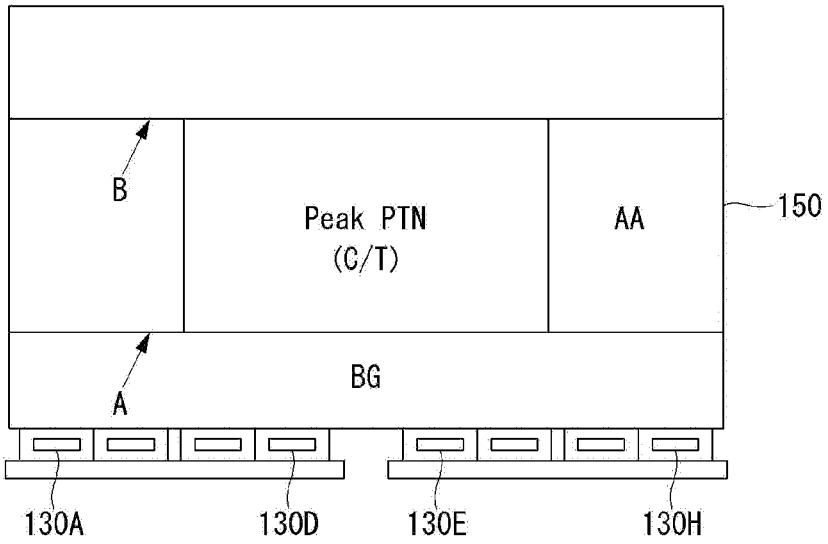
FIG. 9 illustrates a problem of image quality resulting from a parasitic capacitor in accordance with one embodiment of the present disclosure.
Figure 10A:
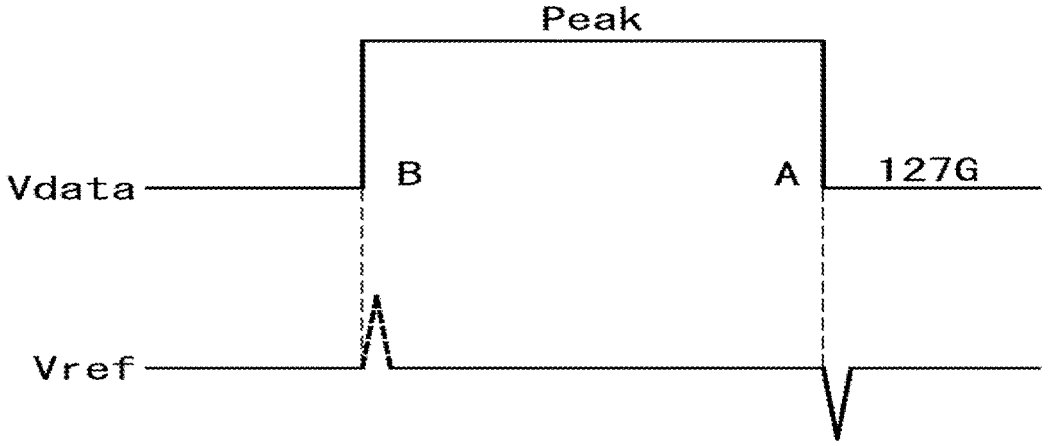
FIGS. 10A and 10B are waveform diagrams for explaining problems according to a related art.
Figure 10B:
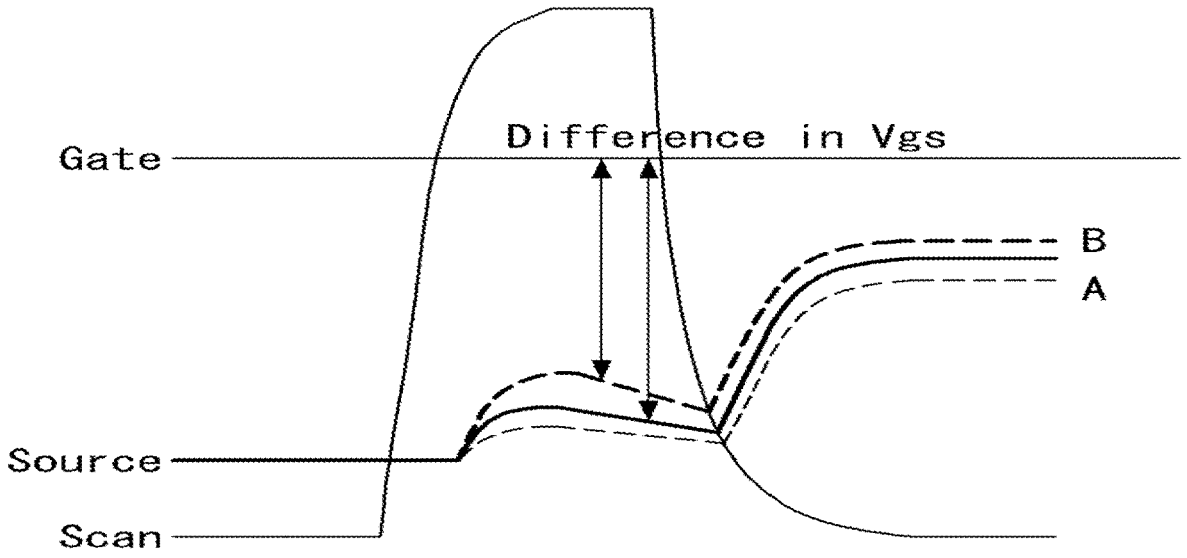
Figure 11:
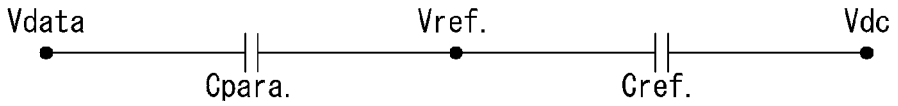
FIG. 11 illustrates a change in a voltage of a sensing line due to a parasitic capacitor in accordance with one embodiment of the present disclosure.

FIG. 8 illustrates a formation portion of a parasitic capacitor. FIG. 9 illustrates a problem of image quality resulting from a parasitic capacitor. FIGS. 10A and 10B are waveform diagrams for explaining problems according to a related art. FIG. 11 illustrates a change in a voltage of a sensing line due to a parasitic capacitor.

As shown in FIGS. 8 to 11, an external compensation method performs an external compensation operation for charging a first sensing line VREF1 with a specific voltage, sensing a voltage present in a line capacitor Cref1 of the first sensing line VREF1, and compensating for a variation in a threshold voltage or mobility of a driving transistor DR based on the sensed voltage.

However, according to an internal structure of a display panel 150, not only the line capacitor Cref1 but also a parasitic capacitor Cpara are present in the first sensing line VREF1. The parasitic capacitor Cpara is formed between a first data line DL1 and the first sensing line VREF1.

When a data voltage Vdata transmitted through the first data line DL1 changes, a first reference voltage Vref present in the line capacitor Cref1 of the first sensing line VREF1 also changes due to coupling between the data voltage Vdata and the parasitic capacitor Cpara.

Because of this, a dark color (for example, black) and a rectangular white peak pattern Peak PTN (or 127G) are displayed on a background screen BG of the display panel 150, a crosstalk belonging to the problem of the image quality is generated at boundaries "A" and "B". In FIG. 9, reference numerals 130A to 130H are data drivers.

As shown in FIG. 10A, when the data voltage Vdata for displaying the rectangular white peak pattern Peak PTN is input, coupling of the parasitic capacitor Cpara occurs according to a change in the data voltage Vdata. Further, the first reference voltage Vref of the first sensing line VREF1 also changes due to the coupling of the parasitic capacitor Cpara.

For example, the first reference voltage Vref may increase when the data voltage Vdata increase at the boundary "B". Further, the first reference voltage Vref may decrease when the data voltage Vdata decreases at the boundary "A".

As shown in FIG. 10B, when the coupling of the parasitic capacitor Cpara occurs, gate-to-source voltages Vgs of switching transistors positioned at the boundaries "A" and "B" are changed. Hence, there occurs a difference between the gate-to-source voltages Vgs at the boundaries "A" and "B". In FIG. 10B, "Scan" denotes a scan signal, "Gate" denotes a voltage applied to a gate electrode of the switching transistor, and "Source" denotes a voltage applied to a source electrode of the switching transistor.

As shown in FIG. 11, a variation ΔVref of the first reference voltage Vref across the first sensing line VREF1 may be expressed as follows: ΔVref=Cpara./(Cpara.+Cref.) *ΔVdata. In the above equation, "Cpara." is a capacitance of the parasitic capacitor, "Cref." is a capacitance of the line capacitor, "ΔVdata" is a variation of the data voltage, and "Vdc" is a DC power.

The problem caused by the coupling of the parasitic capacitor Cpara increases as a resolution of the display panel increases. This is because the capacitance of the parasitic capacitor increases as the resolution of the display panel increases. Therefore, when a high-resolution display panel is manufactured by a method according to the related art, crosstalk may be intensified, and the improvement thereof is required.

First Embodiment

Figure 12:
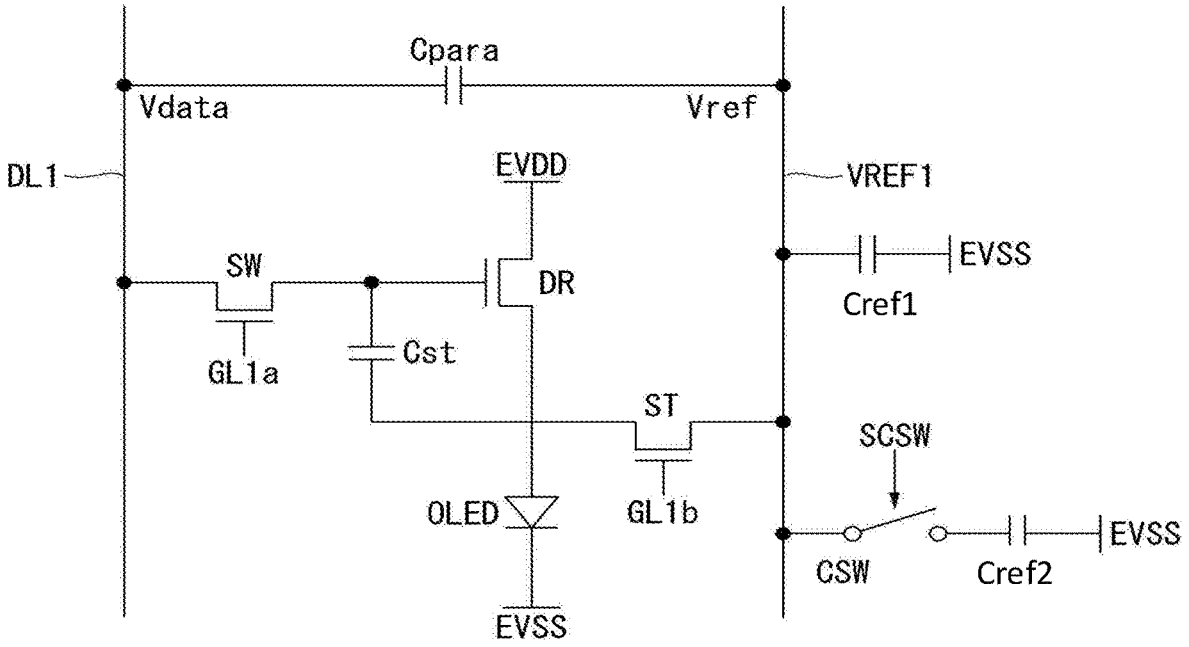
FIG. 12 illustrates an example of a detailed circuit configuration of a subpixel for explaining a compensation concept according to a first embodiment of the disclosure.
Figure 13:
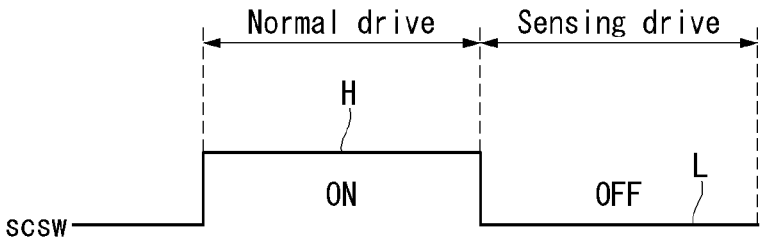
FIG. 13 is a driving waveform diagram of a control switch shown in FIG. 12 in accordance with one embodiment of the present disclosure.
Figure 14:
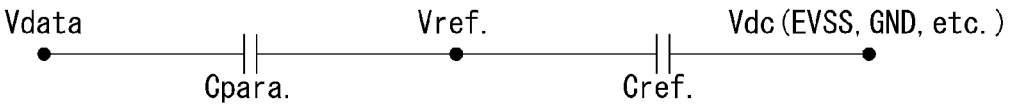
FIG. 14 illustrates change in a voltage of a sensing line due to a compensation capacitor and a parasitic capacitor in accordance with one embodiment of the present disclosure.
Figure 15:
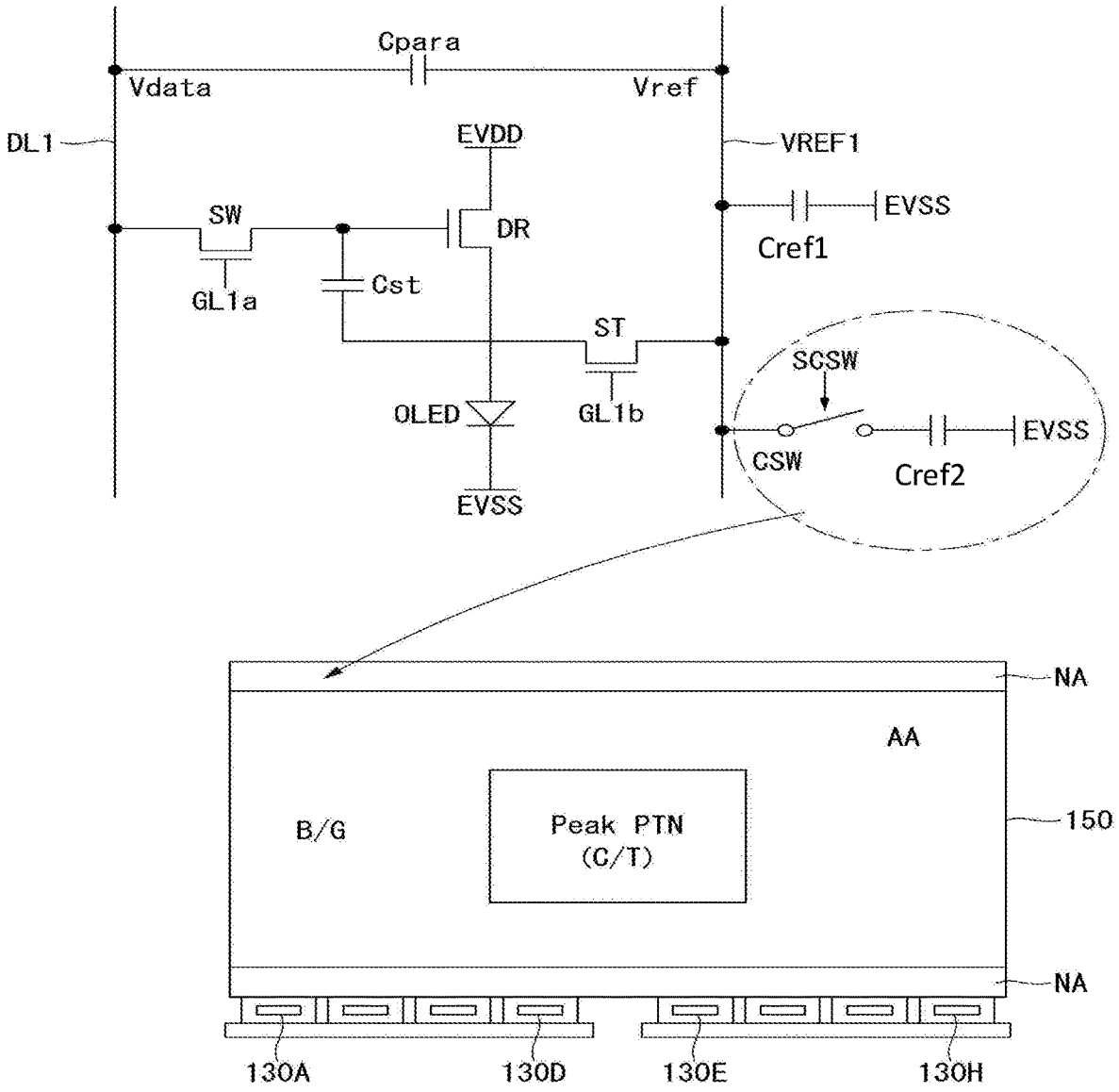
FIG. 15 illustrates a display panel in which a parasitic capacitor compensation circuit according to a first embodiment of the disclosure is implemented.

FIG. 12 illustrates an example of a detailed circuit configuration of a subpixel for explaining a compensation concept according to a first embodiment of the disclosure. FIG. 13 is a driving waveform diagram of a control switch shown in FIG. 12. FIG. 14 illustrates change in a voltage of a sensing line due to a compensation capacitor and a parasitic capacitor. FIG. 15 illustrates a display panel in which a parasitic capacitor compensation circuit according to the first embodiment of the disclosure is implemented. FIG. 16 are waveform diagrams for explaining an improvement according to the first embodiment of the disclosure.

As shown in FIGS. 12 to 14, the first embodiment of the disclosure includes a parasitic capacitor compensation circuit separately including a compensation capacitor Cref2 and a control switch CSW and reduces an influence of a parasitic capacitor on each sensing line using the parasitic capacitor compensation circuit.

The control switch CSW includes a first electrode connected to a first sensing line VREF1, a second electrode connected to one end of the compensation capacitor Cref2, and a gate electrode connected to a switch control line SCSW. The control switch CSW may include transistors. One end of the compensation capacitor Cref2 is connected to the second electrode of the control switch CSW, and the other end is connected to a second power line EVSS. When the control switch CSW is turned on, a line capacitor Cref1 and the compensation capacitor Cref2 are connected in parallel.

In a normal driving (or an image display operation) operation in which an image is displayed on a display panel 150 (see FIG. 15), the compensation capacitor Cref2 has a predetermined capacitance according to a second power voltage supplied through the second power line EVSS. However, when an image is not displayed on the display panel 150 and an external compensation operation is performed to compensate for the components, the compensation capacitor Cref2 is in an electrically floating state.

The control switch CSW performs a turn-on operation "ON" or a turn-off operation "OFF" in response to a switch control signal scsw applied through the switch control line SCSW. The switch control signal scsw may be output from a timing controller or a compensation driver, but is not limited thereto.

When the display panel 150 performs the normal driving operation, the control switch CSW is turned on in response to the switch control signal scsw of a high logic level H. In the normal driving operation of the display panel 150, a total capacitance of all the capacitors of the first sensing line VREF1 increases by a capacitance (refer to Cref. And Cpara.) of the compensation capacitor Cref2 added to the line capacitor Cref1 that is an intrinsic component of the first sensing line VREF1. The compensation capacitor Cref2 is designed (determined by an experimental value) to have such a capacitance that change in the parasitic capacitor Cpara resulting from the coupling has a small effect (or that there is a small change in a first reference voltage Vref resulting from the coupling).

However, when the display panel 150 performs a sensing drive operation, the control switch CSW is turned off in response to the switch control signal scsw of a low logic level L. In the sensing drive operation of the display panel 150, the line capacitor Cref1 and the compensation capacitor Cref2 are separated from each other in order to remove and prevent a sensing error. When the control switch CSW is implemented as a P-type transistor instead of an N-type transistor, the control switch CSW may be turned on or off in response to a signal opposite to the switch control signal scsw of the low logic level L.

As shown in FIG. 14, a variation ΔVref of a first reference voltage Vref across the first sensing line VREF1 in accordance with the application of the parasitic capacitor compensation circuit may be expressed as follows: ΔVref ↓=Cpara./(Cpara.+Cref.↑)*ΔVdata. In the above equation, "Cpara." is a capacitance of the parasitic capacitor, "Cref." is a capacitance of the line capacitor, "ΔVdata" is a variation of the data voltage, and "VDC" is a DC power (for example, EVSS, GND, etc.).

As described above, the first embodiment of the disclosure can reduce the coupling resulting from the parasitic capacitor by increasing the capacitance of the line capacitor Cref of each sensing line in the normal driving operation of the display panel 150.

As shown in FIGS. 15 and 16, in the first embodiment of the disclosure, the parasitic capacitor compensation circuit including the compensation capacitor Cref2 and the control switch CSW is disposed in a non-display area NA disposed outside a display area AA of the display panel 150. In FIG. 15, reference numerals 130A to 130H are data drivers.

The parasitic capacitor compensation circuit including the compensation capacitor Cref2 and the control switch CSW may be disposed in a first non-display area NA (for example, an upper non-display area) of the display panel 150, a second non-display area NA (for example, a lower non-display area) of the display panel 150, or first and second non-display areas NA (for example, upper and lower non-display areas) of the display panel 150.

Figure 16A:
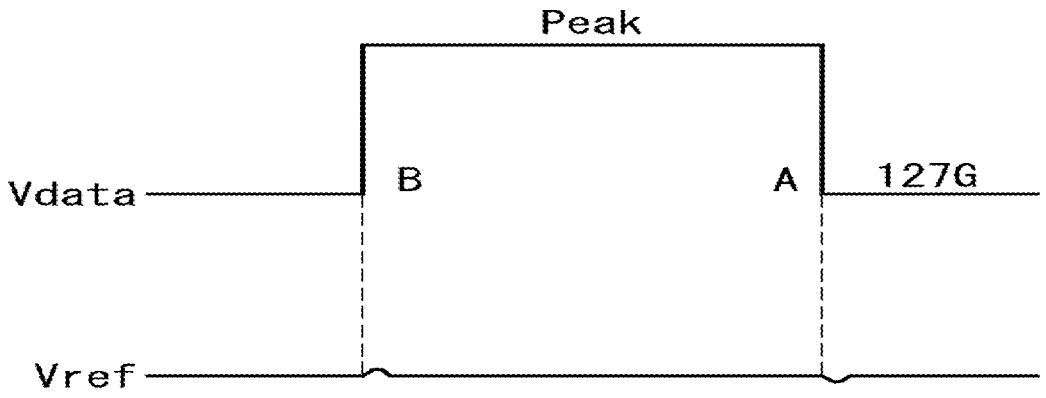
FIGS. 16A and 16B are waveform diagrams for explaining an improvement according to a first embodiment of the disclosure.
Figure 16B:
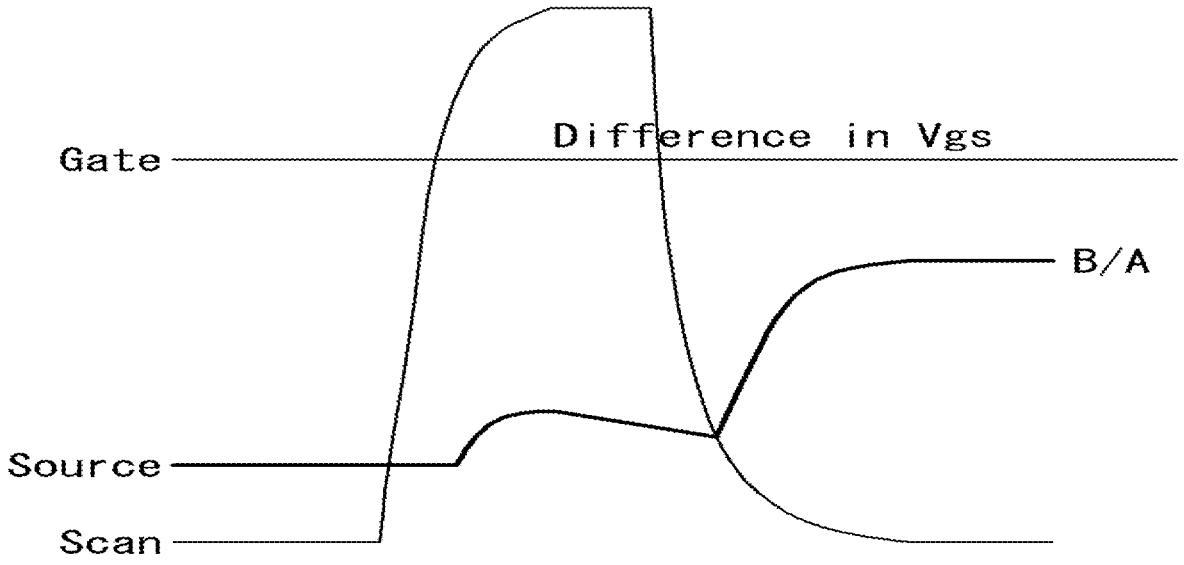

It can be seen from FIG. 16A and FIG. 16B that the first embodiment of the disclosure can substantially uniformly maintain or adjust (or control) a capacitor component, which may be present on the sensing lines, depending on a driving mode of the display panel 150.

Because of this, even when a dark color (for example, black) and a rectangular white peak pattern Peak PTN (or 127G) are displayed on a background screen B/G of the display panel 150, a crosstalk at boundaries "A" and "B" can be prevented (i.e., a variation caused by the coupling can be converged due to a change in a ratio of a capacitance of the line capacitor to a capacitance of the parasitic capacitor resulting from an increase in a capacitance provided by the compensation capacitor) or reduced (for example, to a degree that is not recognized by the eye). As a result, gate-to-source voltages Vgs of switching transistors positioned at the boundary "B" and the boundary "A" may slightly change. Thus, FIG. 16B illustrates the gate-to-source voltages Vgs of the switching transistors positioned at the boundary "B" and the boundary "A" are equal to each other because they slightly change.

Accordingly, the first reference voltage Vref at the boundary "B" may very slightly increase corresponding to an increase in the data voltage Vdata. Further, the first reference voltage Vref at the boundary "A" may very slightly decrease corresponding to a decrease in the data voltage Vdata.

Hereinafter, modification examples of the first embodiment of the disclosure are described.

Second Embodiment

Figure 17:
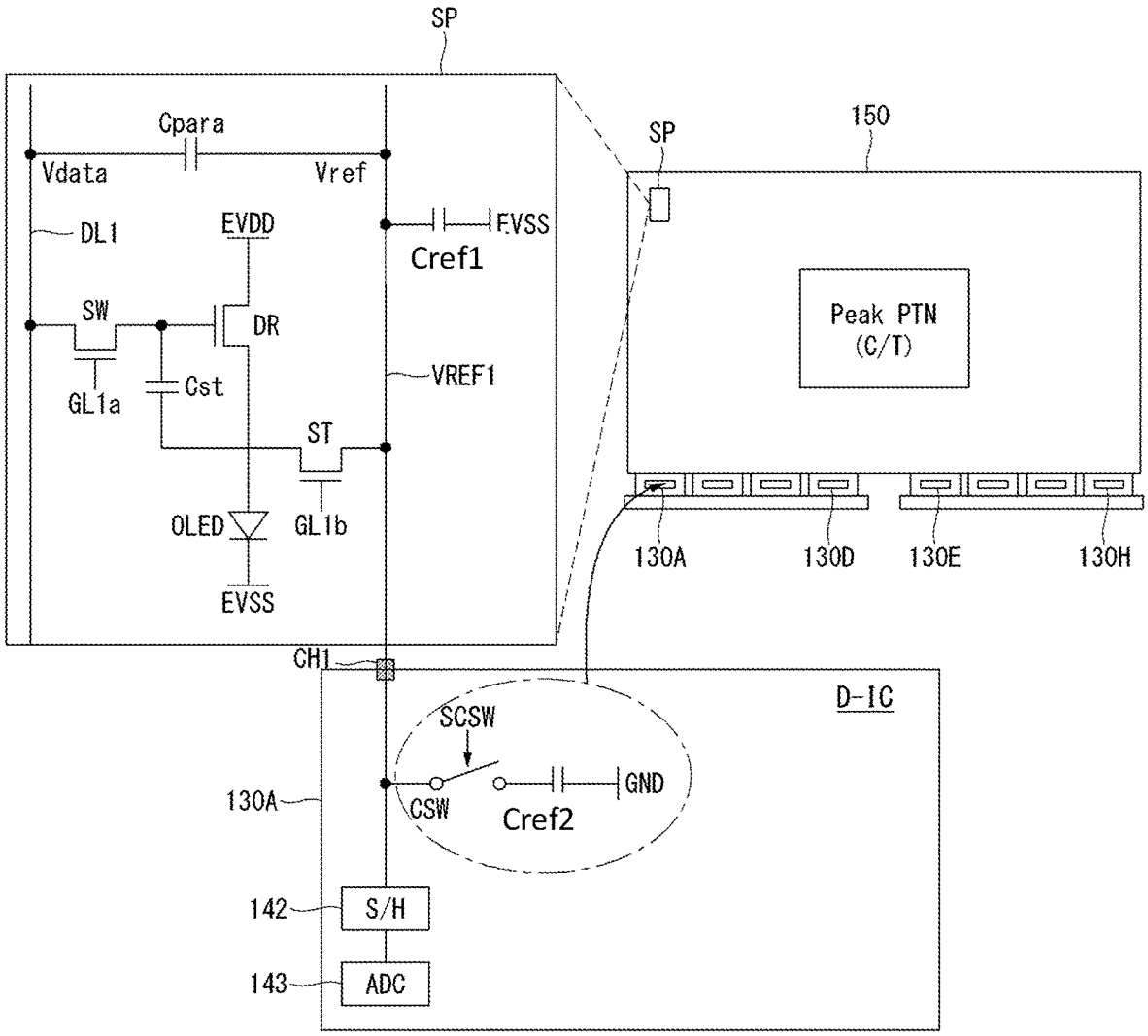
FIG. 17 illustrates a data driver in which a parasitic capacitor compensation circuit according to a second embodiment of the disclosure is implemented.

FIG. 17 illustrates a data driver in which a parasitic capacitor compensation circuit according to a second embodiment of the disclosure is implemented.

As shown in FIG. 17, the parasitic capacitor compensation circuit according to the second embodiment of the disclosure includes a compensation capacitor Cref2 and a control switch CSW and is disposed inside a first data driver 130A. The parasitic capacitor compensation circuit is disposed at an input/output channel terminal that controls a first sensing line VREF1 of the first data driver 130A driving a display panel 150.

The parasitic capacitor compensation circuit may be disposed below a sampling circuit 142 in order to increase a capacitance of a line capacitor Cref1 of the first sensing line VREF1, but is not limited thereto. The parasitic capacitor compensation circuit may be disposed at input/output channels (particularly, controlling the sensing lines) of all the data drivers 130A to 130H for driving the display panel 150.

The control switch CSW includes a first electrode connected to a first sensing channel CH1, a second electrode connected to one end of the compensation capacitor Cref2, and a gate electrode connected to a switch control line SCSW. The control switch CSW may include transistors. One end of the compensation capacitor Cref2 is connected to the second electrode of the control switch CSW, and the other end is connected to a ground line GND. When the control switch CSW is turned on, the line capacitor Cref1 and the compensation capacitor Cref2 are connected in parallel.

In a normal driving (or an image display operation) operation in which an image is displayed on the display panel 150, the compensation capacitor Cref2 has a predetermined capacitance by a ground level voltage supplied through the ground line GND. However, when an image is not displayed on the display panel 150 and an external compensation operation is performed to compensate for the components, the compensation capacitor Cref2 is in an electrically floating state.

The control switch CSW is turned on or off in response to a switch control signal applied through the switch control line SCSW. In the normal driving operation of the display panel 150, the control switch CSW is turned on. On the other hand, in a sensing drive operation of the display panel 150, the control switch CSW is turned off. The switch control signal may be output from a timing controller or a compensation driver, but is not limited thereto.

Third Embodiment

Figure 18:
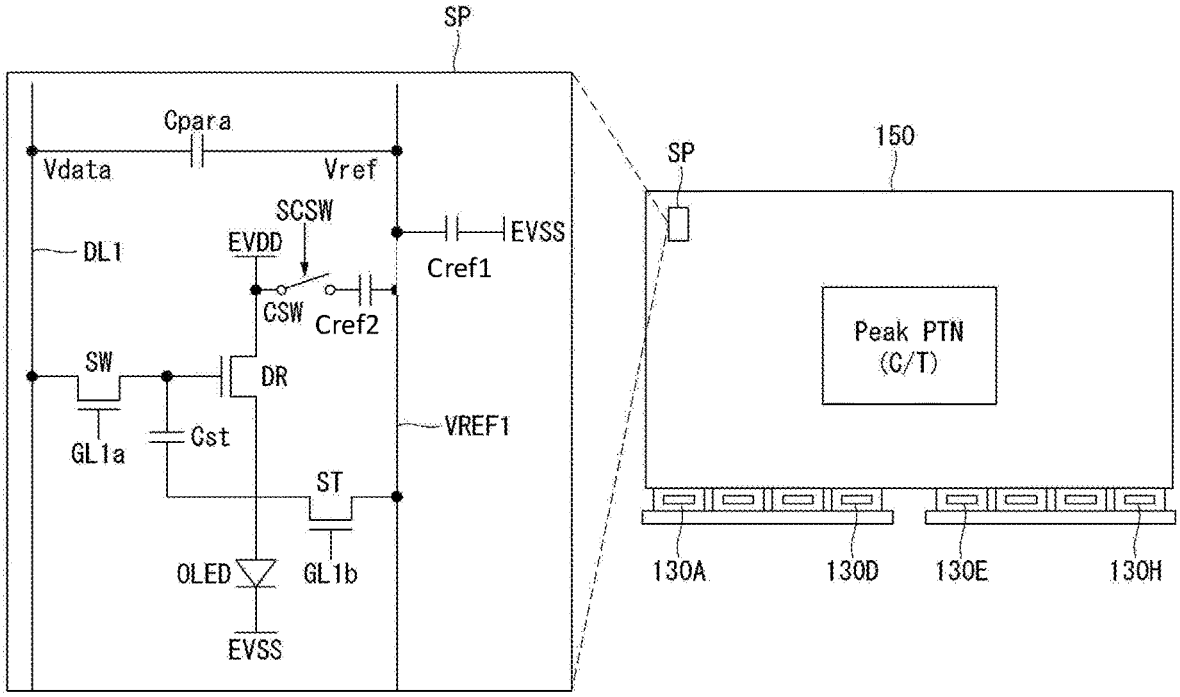
FIG. 18 illustrates a subpixel in which a parasitic capacitor compensation circuit according to a third embodiment of the disclosure is implemented.
Figure 19:
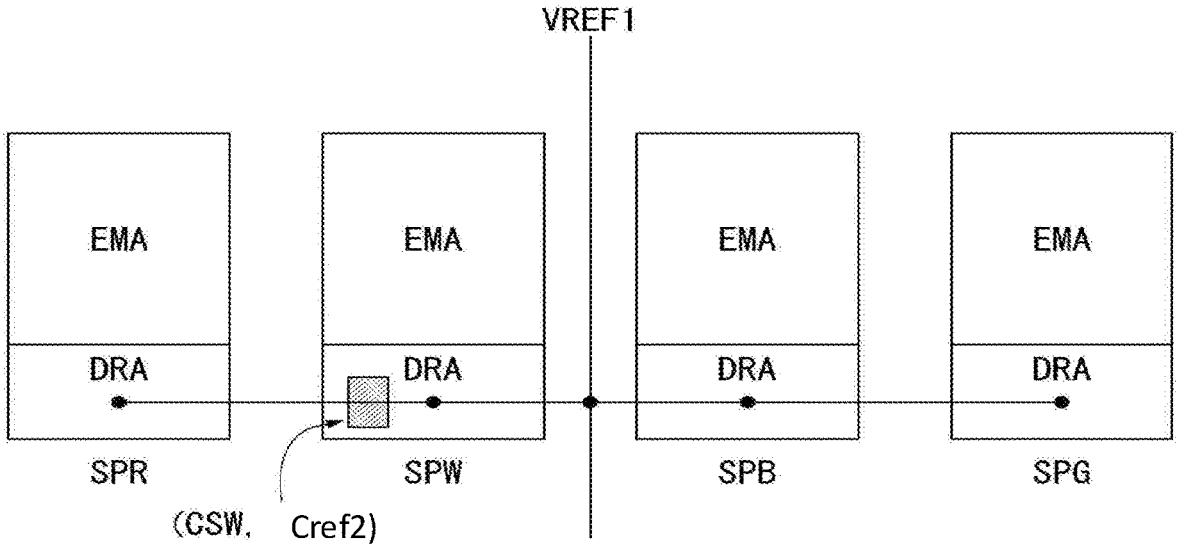
FIG. 19 illustrates an example where a parasitic capacitor compensation circuit is disposed in a unit pixel in accordance with one embodiment of the present disclosure.

FIG. 18 illustrates a subpixel in which a parasitic capacitor compensation circuit according to a third embodiment of the disclosure is implemented. FIG. 19 illustrates an example where a parasitic capacitor compensation circuit is disposed in a unit pixel.

As shown in FIG. 18, the parasitic capacitor compensation circuit according to the third embodiment of the disclosure includes a compensation capacitor Cref2 and a control switch CSW and is disposed inside a subpixel SP.

The parasitic capacitor compensation circuit is disposed to increase a capacitance of a line capacitor Cref1 of a first sensing line VREF1. One end of the compensation capacitor Cref2 is connected to the first sensing line VREF1, and the other end is connected to a first electrode of the control switch CSW. The control switch CSW includes the first electrode connected to the other end of the compensation capacitor Cref2, a second electrode connected to a first power line EVDD, and a gate electrode connected to a switch control line SCSW. The control switch CSW may include transistors. When the control switch CSW is turned on, the line capacitor Cref1 and the compensation capacitor Cref2 are connected in parallel.

In a normal driving (or an image display operation) operation in which an image is displayed on a display panel 150, the compensation capacitor Cref2 has a predetermined capacitance by a first power voltage supplied through the first power line EVDD. However, when an image is not displayed on the display panel 150 and an external compensation operation is performed to compensate for the components, the compensation capacitor Cref2 is in an electrically floating state.

The control switch CSW is turned on or off in response to a switch control signal applied through the switch control line SCSW. In the normal driving operation of the display panel 150, the control switch CSW is turned on. On the other hand, in a sensing drive operation of the display panel 150, the control switch CSW is turned off. The switch control signal may be output from a timing controller or a compensation driver, but is not limited thereto.

As shown in FIG. 19, the first sensing line VREF1 is commonly connected to a red subpixel SPR, a white subpixel SPW, a blue subpixel SPB, and a green subpixel SPG constituting a unit pixel. Because of this, the parasitic capacitor compensation circuit including the compensation capacitor Cref2 and the control switch CSW is selectively disposed in at least one of the red subpixel SPR, the white subpixel SPW, the blue subpixel SPB, and the green subpixel SPG.

For example, the parasitic capacitor compensation circuit may be disposed in the white subpixel SPW that is freest from the problems of a luminance reduction resulting from a reduction in an aperture ratio, a movement of color coordinates, etc. However, embodiments are not limited thereto. For example, the parasitic capacitor compensation circuit may be disposed in a subpixel, which has longest life span or is least affected by changes in characteristics (or time-varying characteristics) of components over time, among the red subpixel SPR, the white subpixel SPW, the blue subpixel SPB, and the green subpixel SPG.

As described above, the embodiments of disclosure reduce the coupling resulting from the parasitic capacitor when implementing the display device using the external compensation method, thereby improving the display quality in the image display operation and removing and preventing the sensing error in the sensing drive operation. Furthermore, the embodiments of disclosure can reduce or prevent the crosstalk resulting from changes of the reference voltage when implementing the display device using the external compensation method.

Although the embodiments have been described with reference to a number of illustrative embodiments thereof, numerous other modifications and embodiments may be devised by those skilled in the art that will fall within the scope of the principles of this disclosure. In particular, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

a display panel configured to display an image; and a parasitic capacitor compensation circuit including a compensation capacitor connected to a sensing line of the display panel and a control switch configured to perform a switching operation so that the compensation capacitor has a predetermined capacitance, wherein the compensation capacitor is connected to the sensing line responsive to the control switch being turned on in an image display operation during which the image is displayed on the display panel, and the compensation capacitor is disconnected from the sensing line responsive to the control switch being turned off in a sensing operation during which a characteristic of a subpixel of the display panel that is connected to the parasitic capacitor compensation circuit is sensed.

2. The display device of claim 1, wherein the parasitic capacitor compensation circuit is disposed in a non-display area of the display panel.

3. The display device of claim 1, wherein the parasitic capacitor compensation circuit is disposed inside a data driver driving the display panel.

4. The display device of claim 1, wherein the parasitic capacitor compensation circuit is disposed in at least one of red, green, blue, and white subpixels.

5. The display device of claim 1, wherein the control switch performs a switching operation for applying a DC power to the compensation capacitor.

6. The display device of claim 1, wherein the compensation capacitor is charged with a voltage corresponding to a high potential voltage or a low potential voltage by a turn-on operation of the control switch.

7. The display device of claim 1, wherein the sensing line has a capacitance according to a parallel connection between the compensation capacitor and a line capacitor, that is an intrinsic component of the sensing line, by a turn-on operation of the control switch.

8. The display device of claim 1, wherein the control switch performs the switching operation according to a logic level of a switch control signal supplied from a timing controller.

9. A display device comprising:

a display panel including a plurality of subpixels;

a compensation circuit including a sensing transistor and a sensing line, the sensing transistor configured to sense a sensing node between a source electrode of a driving transistor included in each subpixel and an anode electrode of an organic light emitting diode included in each subpixel, the sensing line configured to transmit a sensing result obtained by the sensing transistor; and a parasitic capacitor compensation circuit including a compensation capacitor connected to the sensing line of the compensation circuit and a control switch configured to perform a switching operation, wherein the compensation capacitor is connected to the sensing line responsive to the control switch being turned on in an image display operation during which an image is displayed on the display panel by applying a voltage to the compensation capacitor and the compensation capacitor is disconnected from the sensing line responsive to the control switch being turned off in a sensing operation during which a characteristic of a subpixel of the plurality of subpixels that is connected to the parasitic capacitor compensation circuit is sensed by electrically floating the compensation capacitor.

10. The display device of claim 9, wherein the control switch performs the switching operation for applying a DC power to the compensation capacitor.

11. The display device of claim 9, wherein the compensation capacitor is charged with a voltage corresponding to a high potential voltage or a low potential voltage by a turn-on operation of the control switch.

12. The display device of claim 9, wherein the sensing line has a capacitance according to a parallel connection between the compensation capacitor and a line capacitor, that is an intrinsic component of the sensing line, by a turn-on operation of the control switch.

13. A method of driving a display device including a display panel including a plurality of subpixels, a compensation circuit including a sensing transistor sensing a sensing node between a source electrode of a driving transistor included in each subpixel and an anode electrode of an organic light emitting diode included in each subpixel and a sensing line transmitting a sensing result obtained by the sensing transistor, and a parasitic capacitor compensation circuit including a compensation capacitor connected to the sensing line and a control switch performing a switching operation so that the compensation capacitor has a predetermined capacitance, the method comprising:

connecting the compensation capacitor to the sensing line responsive to the control switch being turned on in an image display operation during which the image is displayed on the display panel; and disconnecting the compensation capacitor from the sensing line responsive to the control switch being turned off in a sensing operation during which a characteristic of a subpixel of the display panel of the plurality of subpixels that is connected to the parasitic capacitor compensation circuit is sensed.

14. The method of claim 13, wherein when the control switch is turned on, a DC power is applied to the compensation capacitor.

15. The method of claim 14, wherein the compensation capacitor is charged with a voltage corresponding to a high potential voltage or a low potential voltage by a turn-on operation of the control switch.

16. The method of claim 13, wherein when the control switch is turned on, the sensing line has a capacitance according to a parallel connection between the compensation capacitor and a line capacitor that is an intrinsic component of the sensing line.

* * * * *